United States Patent [19]

White et al.

[11] Patent Number: 4,780,105

[45] Date of Patent: Oct. 25, 1988

[54] COMPOSITION FOR DYEING MATERIAL OF SYNTHETIC AROMATIC POLYAMIDE FIBERS: CATIONIC DYE AND N-ALKYL PHTHALIMIDE

[75] Inventors: W. Edward White; Michael W. Ensley, both of Greensboro; Frank M. Dalton, Madison, all of N.C.

[73] Assignee: Stockhausen, Inc., Greensboro, N.C.

[21] Appl. No.: 38,513

[22] Filed: Apr. 15, 1987

[51] Int. Cl.[4] ..... C09B 67/00; C09B 44/00

[52] U.S. Cl. ..... 8/574; 8/586; 8/654; 8/655; 8/657; 8/925

[58] Field of Search ..... 8/586, 925, 574

[56] References Cited

U.S. PATENT DOCUMENTS

| | | | |
|---|---|---|---|
| 3,471,248 | 10/1969 | Schaenble et al. | 8/580 |
| 3,674,420 | 7/1972 | Sapers | 8/607 |
| 3,953,168 | 4/1976 | Fabbri et al. | 8/531 |
| 4,059,403 | 11/1977 | Wolf et al. | 8/489 |
| 4,066,396 | 1/1978 | Wolf et al. | 8/489 |
| 4,705,523 | 11/1987 | Hussamy | 8/490 |
| 4,705,527 | 11/1987 | Hussamy | 8/574 |
| 4,710,200 | 12/1987 | Cates et al. | 8/574 |

*Primary Examiner*—A. Lionel Clingman

*Attorney, Agent, or Firm*—Shefte, Pinckney & Sawyer

[57] ABSTRACT

A composition for dyeing material of synthetic aromatic polyamide fibers, including a cationic dye and a dye assistant, which is a mixture of N-substituted phthalimide and an emulsifier. The N-substituted phthalimide is preferably a 2:1 mole ratio of N-butyl phthalimide and isopropyl phthalimide. The emulsifier is preferably propylene oxide and ethylene oxide block polymer, and an anionic surfactant blend and an anionic/cationic surfactant blend.

9 Claims, No Drawings

COMPOSITION FOR DYEING MATERIAL OF SYNTHETIC AROMATIC POLYAMIDE FIBERS: CATIONIC DYE AND N-ALKYL PHTHALIMIDE

The present invention relates to a composition for dyeing material of synthetic aromatic polyamide fibers, and more particularly to such a dyeing composition comprised of a cationic dye and a dye assistant mixture of an N-substituted phthalamide and an emulsifier.

Textile fabrics made of aromatic polyamide fibers have long been recognized for their excellent fire retardancy having very high melting points and not igniting at temperatures above their char points. For this reason they are the primary material used by fire fighters, race cars drivers, astronauts and other persons who may be subjected to fire or high temperature.

However, it has been difficult to dye such aromatic polyamide material satisfactorily and despite continuing efforts, the main commercial method of dyeing aromatic polyamide material used at present is a system using aryl ketones, such as acetophenone, as a dye assist, which was disclosed in the 1972 patent to Sapers, U.S. Pat. No. 3,674,420. But such dye assists are objectionable because of their strong, obnoxious odor, which not only permeates the dye house but also imparts a residual odor to the fabric, their corrosive effect on equipment, their harmful effect on personnel (they are classified as hypnotic), their harmful effect as an air and water pollutant, and their degradation effect on cellulosic fibers. Yet, despite these objectionable characteristics, aryl ketones, and particularly acetephenone, are still the common dye assistant used and no one has been able to develop a dye assistant that overcomes the above objections in a commercially acceptable manner. Nomex Type III 455 is a manufactured fiber in which the fiber forming substance is a long chain synthetic polyaramide in which at least 85% of the amide $$(-\underset{\underset{O}{\|}}{C}-NH-)$$

linkages are attached directly to two aromatic rings, and having the formula:

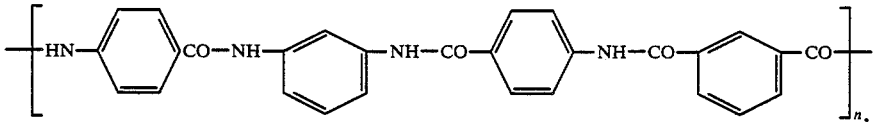

By the present invention, a dye assistant for use in a cationic dye composition for dyeing fibrous material of aromatic polyamide fibers is provided that has little or no obnoxious odor, has no corroding effect on equipment, has no known toxicological effect on personnel, is less of a pollutant than aryl ketones, and does not significantly degrade cellulosic fibers. Furthermore, in some applications it may even improve fire retardancy.

Briefly described, the present invention provides a composition for dyeing material of synthetic aromatic polyamide fibers comprising a cationic dye and a dye assistant. The dye assistant is a mixture of N-substituted phthalimide and an emulsifier selected from the group consisting of the mixture of a propylene oxide and ethylene oxide block polymer and a surfactant, the mixture of oxyalkylated alkyl alcohol, oxyalkylated phenolic resin and an ethoxylated alkyl phosphate ester, the mixture of isopropylamine salt of dodecyl benzene sulfonic acid and ethoxylated nonyl phenol, the mixture of isopropylamine salt and dodecyl benzene sulfonic acid and ethoxylated soya amine, and the mixture of isopropylamine salt of dodecyl benzene sulfonic acid and ethoxylated castor oil.

The N-substituted phthalimide is selected from the group consisting of N-butyl phthalimide, N-isopropyl phthalimide, N-ethyl phthalimide, N-isobutyl phthalimide, N-2-ethyl-hexyl phthalimide, N-ethoxymethyl phthalimide, N-propoxy-methyl phthalimide, N-methyl carbonyl-N-methexyl phthalimide, and N-propoxymethyl phthalimide. Preferably, the N-substituted phthalimide is a mixture of N-Butyl phthalimide and N-isopropyl phthalimide. In the preferred embodiment these components are mixed in a 2:1 mole ratio, and in a composition containing approximately 80% by weight of the N-substituted phthalimide and approximately 20% by weight emulsifier.

Preferably, the emulsifier is a propylene oxide and ethylene oxide block polymer and a surfactant, with the surfactant being an anionic surfactant blend of the diethyl sulfate quaternary of a fatty tertiary amine, ethoxylated nonyl phenol, and a dodecylbenezene sulfonic acid amine salt, and an anionic/cationic blend of dodecylbenzene sulfonic acid amine salt and a low cloud point ethoxylated nonyl phenol. In the preferred embodiment the emulsifier is approximately 50% by weight of the block polymer, approximately 25% by weight of the anionic surfactant blend and approximately 25% by weight of the anionic/cationic surfactant blend.

Typically the present invention is used in dyeing fabric made of Nomex Type III 455 made by E. I. duPont de Nemours & Co. and other similar material. Cationic dyes are used, with the percentage of dye being dependent on the depth of shade required. The preferred N-substituted phthalimide is N-butyl phthalimide and isopropyl phthalimide mixed in a mole ratio of 2:1, which provides an eutectic mixture having characteristics particularly suited for use in a dyeing assistant system.

Preferably, the proportion of dye assistant to dye bath is 1.5% to 2.0 percent by weight. In addition, 1% to 2% of sodium nitrate is recommended and the dye bath is adjusted to a pH of 3.0 with acetic or formic acid. The pH range may be between 2.5 and 4, with formic acid being used if the pH is to be below 3.

In the following examples, the dyes identified as Basic Yellow 21, Basic Blue 41, and Basic Red 18 are identified further in the Color Index, Third Edition, published by The Society of Dyers and Colourists, Dean House, Piccadilly Bradford, Yorkshire, England.

EXAMPLE I

A dye assistant was prepared that consisted of 80% phthalimide mixture of a 2:1 mole ratio of N-butyl phthalimide and isopropyl phthalimide and 20% emulsifier. The emulsifier was composed of 50% propylene oxide and ethylene oxide block polymer, 25% anionic surfactant blend and 25% anionic/cationic surfactant blend. The block polymer was Pluronic 31R1 made by BASF Wyandotte Corp. having the formula $$HO-(\overset{CH_3}{\overset{|}{C}}HCH_2O)_x-(CH_2CH_2O)_y-(\overset{CH_3}{\overset{|}{C}}H_2CHO)_{x1}-H$$

with an average molecular weight of 3250, a viscosity (Brookfield) of 660 cps, a surface tension (0.1%) of 34 dynes/cm, a cloud point (1% aqueous solution) of 25° C. and an HLB value of 1.7. The anionic surfactant blend was Ahco AB-160 made by Imperial Chemical, Inc., which is a mixture of a diethyl sulfate quarternary of a fatty tertiary amine, ethoxylated nonyl phenol, and a dodecylbenzene sulfonic acid amine salt. The anionic/cationic surfactant blend was Ahco AB-118 made by Imperial Chemical, Inc., which is a mixture of a dodecyl benzene sulfonic acid amine salt, and a low cloud point ethoxylated nonyl phenol.

Using this dye assistant, a dye bath was prepared composed of the following by weight of dye bath:

| Components | Percentage |
|---|---|
| Water | 97.25% |
| Dye Assistant | 1.5% |
| Sodium Nitrate | 1.0% |
| Acetic Acid (56%) | 0.05% |
| Basic Yellow 21 | 0.2% |

A fabric composed of 100% Nomex Type III 455 was placed in the dye bath, which was then heated to a temperature of 250° Fahrenheit at a rate of rise of 2° pm and maintained at that temperature for one hour. The temperature was then lowered to 140° Fahrenheit and the dye bath drained and the fabric overflow rinsed.

The fabric was then after scoured with the following composition, by weight of bath:

| Components | Percentage |
|---|---|
| Water | 99.96% |
| Acetic Acid (56%) | 0.02% |
| Emulsifier (as described above) | 0.02% |

The bath was heated to 160° Fahrenheit and maintained at this temperature for 20 minutes. The bath was then drained, the fabric was overflow rinsed and removed, excess water was extracted, and the fabric was dried.

The sample had excellent color yield and no residual odor in the fabric.

EXAMPLE II

The compositions and procedures of Example I were followed, substituting Basic Blue 41, and resulting in the same excellent color yield and no residual odor.

EXAMPLE III

The compositions and procedures of Example I were followed, substituting Basic Red 18, and resulting in the same excellent color yield and no residual odor.

EXAMPLES IV, V AND VI

The composition and procedure of Examples I, II and III were followed, substituting an emulsifier consisting of oxyalkylated alkyl alcohol, oxyalkylated phenolic resin and an ethoxylated alkyl phosphate ester, which emulsifier is marketed under the trade name Witcomul 1054-HF by Witco Co.

The samples had acceptable color yield and no odor results were obtained.

EXAMPLES VII, VIII AND IX

The composition and procedure of Examples I, II and III were followed using an emulsifier consisting of 50% isopropyl amine salt of dodecylbenzene sulfonic acid and 50% ethoxylated nonyl phenol (at a mole ratio of 10 moles of ethylene oxide to one mole of nonyl phenol).

The samples had acceptable color yield and non odor results were obtained.

EXAMPLES X, XI, and XII

The composition and procedure of Examples I, II and III were followed using an emulsifier consisting of 50% isopropyl amine salt of dodecylbenzene sulfonic acid and 50% ethoxylated soya amine (at a mole ratio of 23 moles of ethylene oxide to one mole of soya amine with the amine being a tertiary amine of the composition represented by the formula:

$$R-N\begin{matrix}(CH_2CH_2O)aH \\ (CH_2CH_2O)bH\end{matrix}$$

where R is a $C_{12}$ to $C_{18}$ alkyl group and a+b is the average number of moles of combined ethylene oxide per mole of alkyl amine base, i.e. POE=(a+b)).

The samples had acceptable color yield and no odor results were obtained.

EXAMPLES XIII, XIV AND XV

The composition and procedure of Examples I, II and III were followed using an emulsifier consisting of 50% isopropyl amine salt of dodecylbenzene sulfonic acid and 50% ethoxylated castor oil (40 moles ethylene oxide on castor oil).

The samples had acceptable color yield and no odor results were obtained.

The present invention is not intended to be limited to the specific examples or to the detailed description above. It is understood that the invention is limited only to the scope of the following claims and to equivalents thereof.

We claim:

1. A composition for dyeing material of synthetic aromatic polyamide fibers, comprising a cationic dye and a dye assistant, said dye assistant being a mixture of N-substituted phthalimide selected from the group consisting of N-butyl phthalimide, N-isopropyl phthalimide, N-ethyl phthalimide, N-isobutyl phthalimide, N-2-ethyl-hexyl phthalimide, N-ethoxymethyl phthalimide, N-propoxymethyl phthalimide, and N-methyl carbonyl-N-methexyl phthalimide and an emulsifier selected from the group consisting of the mixture of a propylene oxide and ethylene oxide block polymer and a surfactant, the mixture of oxyalkylated alkyl alcohol, oxyalkylated phenolic resin and an ethoxylated alkyl phosphate ester, the mixture of isopropylamine salt of dodecyl benzene sulfonic acid and ethoxylated nonyl phenol, the mixture of isopropylamine salt of dodecyl benzene sulfonic acid and ethoxylated soya amine, and a mixture of isopropylamine salt of dodecyl benzene sulfonic acid and ethoxylated castor oil.

2. A composition according to claim 1 and characterized further in that said N-substituted phthalimide comprises a mixture of N-butyl phthalimide and N-isopropyl phthalimide.

3. A composition according to claim 2 and characterized further in that said mixture of N-butyl phthalimide and N-isopropyl phthalimide is a 2:1 mole ratio mixture.

4. A composition according to claim 1 and characterized further in that said composition contains approximately 80% by weigh N-substituted phthalimide and approximately 20% by weight emulsifier.

5. A composition according to claim 3 and characterized further in that said composition contains approximately 80% by weight N-substituted phthalimide and approximately 20% by weight emulsifier.

6. A composition according to claim 1 and characterized further in that said emulsifier is said propylene oxide and ethylene oxide block polymer and a surfactant, and said surfactant comprises an anionic surfactant blend of a diethyl sulfate quaternary of a fatty tertiary amine, ethoxylated nonyl phenol, and a dodecylbenzene sulfonic acid amine salt, and an anionic/cationic blend of dodecylbenzene sulfonic acid amine salt and a low cloud point ethoxylated nonyl phenol.

7. A composition according to claim 6 and characterized further in that said emulsifier is approximately 50% by weight block polymer, approximately 25% by weight anionic surfactant blend and approximately 25% by weight anionic/cationic surfactant blend.

8. A composition according to claim 3 and characterized further in that said emulsifier is said propylene oxide and ethylene oxide block polymer and a surfactant, and said surfactant comprises an anionic surfactant blend of a diethyl sulfate quaternary of a fatty tertiary amine, ethoxylated nonyl phenol, and a dodecylbenzene sulfonic acid amine salt, and an anionic/cationic blend of dodecylbenzene sulfonic acid amine salt and a low cloud point ethoxylated nonyl phenol.

9. A composition according to claim 8 and characterized further in that said emulsifier is approximately 50% by weight block polymer, approximately 25% by weight anionic surfactant blend and approximately 25% by weight anionic/cationic surfactant blend.

* * * * *

UNITED STATES PATENT OFFICE

CERTIFICATE OF CORRECTION

Patent No. 4,780,105 Dated October 25, 1988

Inventor(s) W. Edward White, Michael W. Ensley, Frank M. Dalton

It is certified that error appears in the above-identified patent and that said Letters Patent is hereby corrected as shown below:

Col. 1, line 10 delete "phthalamide" and insert — phthalimide —.
Col. 1, line 16 delete "cars" and insert — car —.
Col. 1, line 35 delete "Nomex Type III 455 is a manufactured fiber in which the fiber forming substance is a long chain synthetic polyaramide in which at least 85% of the amide (-C-NH-) linkages are attached directly to two aromatic rings, and having the formula:

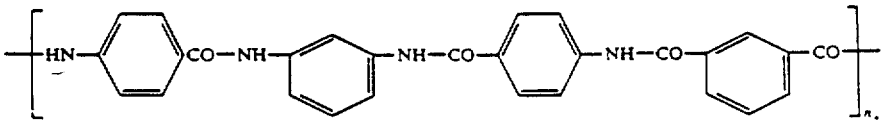

and insert at Col. 2, beginning of line 37.

Col. 4, line 20 after "amine" insert — ) —.
Col. 5, line 10 delete "weigh" and insert — weight —.

Signed and Sealed this

Sixteenth Day of January, 1990

*Attest:*

JEFFREY M. SAMUELS

*Attesting Officer* *Acting Commissioner of Patents and Trademarks*